US009424706B2

(12) United States Patent
Bruner et al.

(10) Patent No.: US 9,424,706 B2
(45) Date of Patent: Aug. 23, 2016

(54) CONTROLLED COIN PORTAL

(71) Applicant: Imonex Services Inc., Sealy, TX (US)

(72) Inventors: Philemon Louis Bruner, Katy, TX (US); Kurt Douglas Regenbrecht, Hallettsville, TX (US)

(73) Assignee: Imonex Services Inc., Sealy, TX (US)

( * ) Notice: Subject to any disclaimer, the term of this patent is extended or adjusted under 35 U.S.C. 154(b) by 0 days.

(21) Appl. No.: 14/458,261

(22) Filed: Aug. 13, 2014

(65) Prior Publication Data

US 2015/0047946 A1 Feb. 19, 2015

Related U.S. Application Data

(60) Provisional application No. 61/866,018, filed on Aug. 14, 2013.

(51) Int. Cl.
*G07F 1/02* (2006.01)
*G07D 11/00* (2006.01)

(52) U.S. Cl.
CPC ..... *G07F 1/02* (2013.01); *G07D 11/0018* (2013.01)

(58) Field of Classification Search
CPC ..... G07D 11/0018; G07F 1/02
USPC ..... 194/344, 351; 232/1 D, 4 R, 14, 44, 55; 446/7, 13
See application file for complete search history.

(56) References Cited

U.S. PATENT DOCUMENTS

| | | | | |
|---|---|---|---|---|
| 864,938 | A * | 9/1907 | Tinsley | 206/0.8 |
| 4,023,728 | A * | 5/1977 | Gamberg | 232/4 R |
| 4,667,093 | A | 5/1987 | MacDonald | |
| 5,647,469 | A | 7/1997 | Yamagishi et al. | |
| 5,647,470 | A | 7/1997 | Bruner et al. | |
| 6,155,399 | A | 12/2000 | Bruner | |
| 7,537,516 | B2 * | 5/2009 | Jenrick | 453/18 |
| 7,635,059 | B1 | 12/2009 | Bruner et al. | |
| 8,727,094 | B2 | 5/2014 | Bruner et al. | |
| 2007/0068768 | A1 * | 3/2007 | Yang | C09K 11/7774 194/334 |
| 2008/0171507 | A1 * | 7/2008 | Kurokawa | 453/18 |

* cited by examiner

*Primary Examiner* — Mark Beauchaine

(57) ABSTRACT

A controlled coin inlet or portal is described that allows for improved alignment of a coin with the coin entry slot of a coin acceptor mechanism. A coin entry slot having at least an upper or lower edge is dimensioned to allow entry of a coin of a desired maximum width in a substantially on-edge orientation. The coin portal may include at least one outwardly extending coin guide slot of substantially corresponding maximum width as the coin entry slot and positioned adjacent to the upper or lower edge of the coin entry slot.

12 Claims, 2 Drawing Sheets

CONTROLLED COIN PORTAL

CROSS REFERENCE TO RELATED APPLICATIONS

This application claims the benefit of U.S. Provisional Application No. 61,866,018 filed on Aug. 14, 2013, the subject matter of which is herein incorporated by reference in its entirety.

FIELD OF THE INVENTION

The present invention relates generally to coin acceptors and rejecters for use in vending machines, coin operated telephones, video game machines, coin operated appliances such as laundry machines and dryers, car washes and other applications where mechanical sorting, selection and rejection of coins is required. More particularly, this invention relates to coin inlets and apparatuses and methods for controlling the entry of coins into coin operated machines and appliances.

BACKGROUND OF THE INVENTION

Coin acceptance and collection systems are used in a wide variety of applications, including telephones, vending machines, coin operated appliances and the like. To increase the profitability of such coin-operated machines and appliances, coin separator/rejecters are required to be reliable, easy to use and difficult to circumvent. If a coin acceptor/rejecter jams easily, it results in expensive service calls. In addition, the coin acceptor/rejecter must be convenient for the user to insert coins into the machine. And, of course, the coin acceptor/rejecter must be tamper resistant to minimize the problem of users that attempt to beat the coin acceptance and collection system.

Regarding reliability, over the years coin acceptor/rejecters have evolved to be smaller and more efficient. For example, U.S. Pat. No. 5,988,349 describes a coin separator/rejecter that can efficiently separate coins in a small footprint and with a minimum number of moving parts.

One disadvantage of coin-operated machines is that they are not equally convenient for all users to operate. The entry portals for coins are dimensioned to accept coins of the desired diameter and width. Accordingly, the slots are narrow, making them difficult for certain persons with disabilities, such as those who are blind or visually impaired, to operate the machines or appliances. In addition, the narrow slots can be difficult to locate and use in areas that are dark or dimly lit.

Another common problem for owners or operators of such systems is the act of tampering with the coin acceptor/rejecter to obtain free products or services. For example, some users attempt to trigger the mechanism without the use of coins by, for example, pouring liquids into the coin race. Another type of tampering involves packing or stuffing the coin acceptor/rejecter mechanism with a blocking element, such as a straw or wad of paper in such a way as to block the coin race above the coin acceptance portion of the collection system, allowing blocked coins to accumulate in the mechanism for later retrieval.

Other users employ slugs or low-value coins, such as pennies, to obtain services or products. In this method, the user takes advantage of the lack of control over the speed and angle of the coin entering the acceptor. Drop acceptors, which have been on the market for decades, are particularly susceptible to this problem. Other attempts to control the coin inlet include, for example, blocking off the inlet area completely from a direct coin insertion into the race, or inserting the coin from the side. However, this is an undesirable solution because it is not user-friendly. These solutions are not intuitive because they vary from the normal operation of coin-operated devices. In addition, such solutions result in a slower insertion of coins into the coin race.

One particularly troubling example of taking advantage of the lack of control over the speed and angle of the coin entering the race is the penny-flipping method. In this method, the user holds the penny at the top and positions the penny in the coin entry slot. With the finger of the other hand, the user then flicks the bottom edge of the penny, making the penny enter the coin race at an upward angle and at a higher than normal speed, thereby catching the accept area of the acceptor or otherwise missing the initial coin rejection pathway.

Tampering results in numerous undesired consequences. The owner's profit is reduced because products or services are taken for little or no money. Customers lose money or are unable to receive the purchased product. In addition, the tampering often results in damage to the coin acceptor/rejecter itself, either from the tampering or by the actions of frustrated customers. Methods and apparatuses designed to inhibit the ability to tamper with coin acceptor/rejecters are disclosed in, for example, U.S. Pat. Nos. 5,647,470 and 6,155,399.

Thus, while the efficiency and reliability of coin acceptor/rejecters have increased, there exists a need for improvements in the ease of use and tamper resistance of coin acceptor/rejecter mechanisms.

SUMMARY OF THE INVENTION

The present invention is a controlled coin inlet or portal that allows for improved alignment of a coin with the coin entry slot of a coin acceptor mechanism. The apparatus of the present invention comprises a substantially vertical coin entry slot having at least an upper or lower edge. The coin entry slot is dimensioned to allow entry of a coin of a desired maximum width in a substantially on-edge orientation. The controlled coin portal further comprises at least one outwardly extending coin guide slot of substantially corresponding maximum width as the coin entry slot and positioned adjacent to the upper or lower edge of the coin entry slot.

The coin entry slot can further comprise both an upper and lower edge such that the coin entry slot can be dimensioned to allow entry of a coin of a selected maximum diameter. The controlled coin portal can further include inwardly sloping finger guides adjacent to the coin entry slot and dimensioned to guide fingers holding a coin to align the coin with the coin entry slot. In addition, the controlled coin inlet can include a second outwardly extending coin guide slot of substantially corresponding maximum width as the coin entry slot and positioned adjacent to the opposite edge of the coin entry slot. In this embodiment, the outwardly extending coin guide slots can simultaneously engage the upper and lower edges of a coin to align the coin with the coin entry slot.

One feature of the present invention is the ability to limit the angle of the coins entering the coin acceptor and to control the speed of the coin, which enhances coin flow into the acceptor. The present invention further serves to inhibit tampering with the coin acceptor mechanism by inhibiting access to the coin inlet of the mechanism to other than a controlled insertion of a coin into the coin acceptor mechanism.

BRIEF DESCRIPTION OF THE DRAWINGS

Embodiments of the present invention are illustrated with reference to the accompanying drawings.

DETAILED DESCRIPTION OF THE INVENTION

Figure 1:
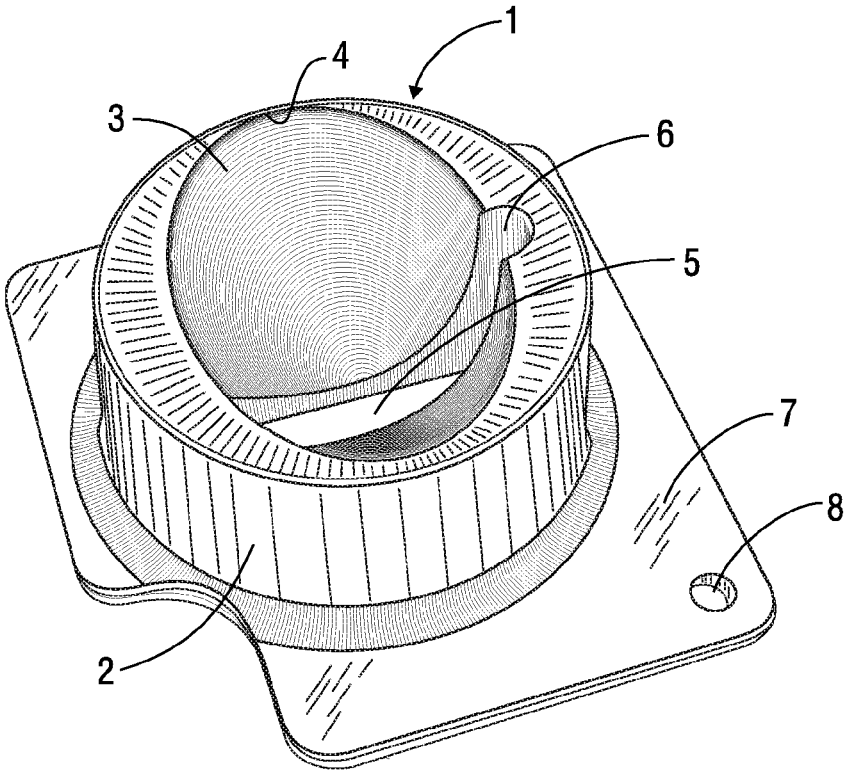
FIG. 1 illustrates a perspective view of one embodiment of a controlled coin portal of the present invention showing a coin entry slot, a coin guide slot and a curvilinear interior surface on each side of the coin entry slot.

As used herein, the terms "comprises," "comprising," "includes," "including," "has," "having," or any other variation thereof, are intended to cover a non-exclusive inclusion. For example, processes, methods, articles, or apparatuses that comprise a list of elements are not necessarily limited to only those elements but may include other elements not expressly listed or inherent to such processes, methods, articles, or apparatuses. Further, unless expressly stated to the contrary, "or" refers to an inclusive "or" but not to an exclusive "or". For example, a condition A or B is satisfied by any one of the following: A is true (or present) and B is false (or not present), A is false (or not present) and B is true (or present), and both A and B are true (or present).

Also, use of "a" or "and" are employed to describe the elements and components of the invention. This is done merely for convenience and to give a general sense of the invention. This description includes one or at least one and the singular also includes the plural unless it is obvious that it is meant otherwise.

Unless otherwise defined, technical and scientific terms used herein have the same meaning as commonly understood by one of ordinary skill in the art to which this invention belongs. Although methods that are similar or equivalent to those described herein can be used in the practice or testing of the present invention, suitable methods and materials are described herein. All publications, patent applications, patents, and other references mentioned herein are incorporated by reference in their entirety. In case of conflict, the present specification, including definitions, will control. In addition, materials, methods, and examples are illustrative only and not intended to be limiting.

In the following description, numerous specific details, such as the identification of various system components, are provided to understand the embodiments of the invention. One skilled in the art will recognize, however, that embodiments of the invention can be practiced without one or more of the specific details, ordinary methods, components, materials, etc. In still other instances, well-known structures, materials, or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or work characteristics may be combined in any suitable manner in one or more embodiments.

The present invention is directed to aligning and maintaining control of the orientation of coins as coins are inserted into a coin acceptor/rejecter. As discussed above, a typical coin entry portal is a slot dimensioned to accept coins of a desired maximum diameter and a desired maximum width into a primary coin race. Such coin races can be designed to maintain coins in an on-edge orientation and are downwardly inclined. Such coin entry portals are typically slots in flat plates on the outside of coin acceptor bodies. Flat coin entry portals have various disadvantages. People with handicaps can have difficulty locating or positioning the coins for entry into the coin race. In addition, machines can be located in areas where there is insufficient illumination to allow easy alignment with the coin with the coin entry slot.

Another disadvantage of typical coin entry slots is the ability of some users to intentionally misalign the coin with the designed coin race pathway to evade the separation and rejection features of the accepter/rejecter. For example, some users have found that pennies, for example, can be flipped upwards into the primary coin race through the typical flat coin inlet portal. In this case, the user positions the coin partially in the coin inlet portal, places a finger under the lower edge of the partially exposed coin in the coin inlet portal and "flicks" the coin upward into the coin race. Given that modern coin acceptors are designed with small footprints and are required to quickly separate out and reject undesired coins, such as pennies, the flicking of the coin upwards into the primary coin race results in either triggering the coin accept feature or evading the initial rejection features for such coins, thereby allowing the coin to proceed down the race.

The present invention is directed to a controlled coin portal that provides improved coin flow into a coin acceptor/rejecter. The design permits easy location and alignment of the coin for entry into the primary coin race. With the present invention, coins enter the coin race at a desired speed and angle. The design provides for easy insertion of coins into the coin race and inhibits the ability of users to evade the coin rejection features of modern coin acceptor/rejecters.

In the embodiment illustrated, the controlled coin portal of the present invention is shown as a protrusion having a well therein designed for fingers holding a coin to be directed into the coin inlet well inside of the protrusion. Advantageously, the design allows for the blind insertion of a coin into the coin entry slot of a coin-operated machine.

In one embodiment of the present invention, an outwardly extending coin guide is positioned above and adjacent to the upper edge of a coin entry slot that coincides with the entrance to the primary coin race. The width of the outwardly extending coin guide slot is dimensioned to be substantially the same as the coin entry portal. The upper edge of the coin is first engaged by the coin guide slot, which then aligns the coin with the coin entry slot.

Figure 2:
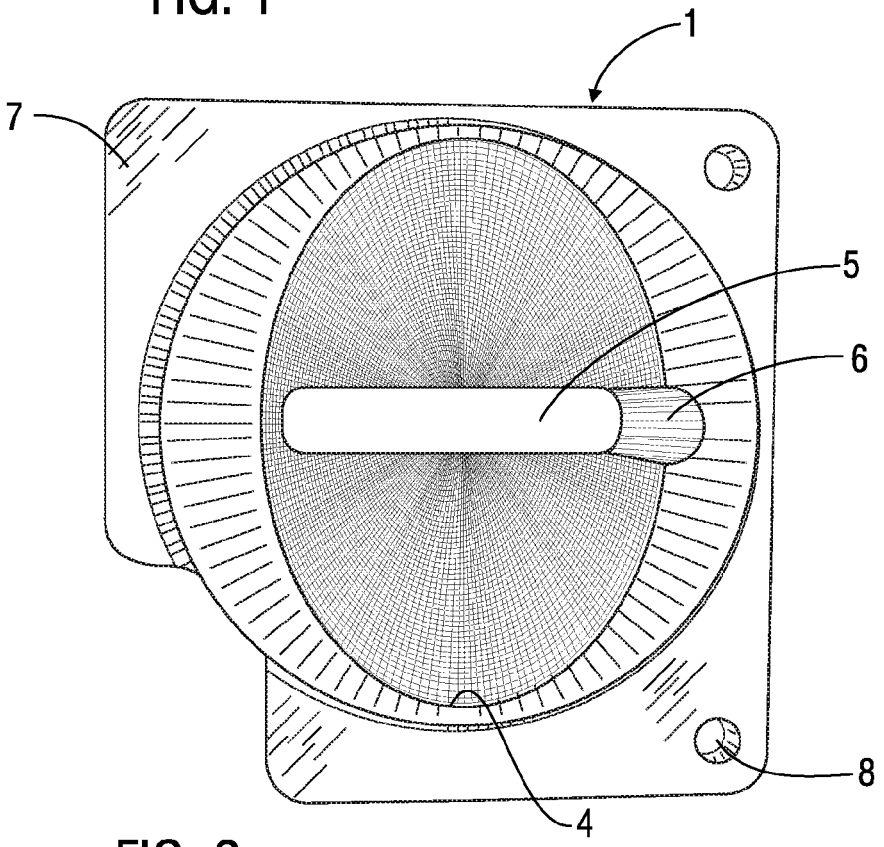
FIG. 2 illustrates a top view of one embodiment of the controlled coin portal of the present invention showing the coin entry slot, the coin guide slot, and a curvilinear interior service on each side of the coin entry slot.

As illustrated in FIGS. 1 & 2, a controlled coin portal member 1 is shown as a protruding member having an exterior surface 2 and an opening formed therein. The opening has an interior surface 3 composed of interior walls that have an outer edge 4 and an inner edge that forms a substantially vertical coin entry slot 5 dimensioned to allow entry of a coin of a selected maximum diameter and width. The outer edge 4 of the interior surface is formed into an opening dimensioned to be wider than the coin entry slot 5 and sufficient to allow at least two fingers to position a coin within the protruding member. A coin guide slot 6 is shown extending outwardly from the upper edge of the coin entry slot to the upper edge of the interior wall. The protruding member is mounted on attachment plate 7 with attachment points 8 for attaching the controlled coin inlet to the face of a coin acceptor/rejecter body.

As shown more specifically in FIGS. 1 & 2, the controlled coin portal is shown having a coin entry slot that is dimensioned to correspond to the coin entry slot on a typical flat-faced coin acceptor/rejecter body. Both the coin entry slot of the coin acceptor/rejecter and the coin entry slot of the present invention are dimensioned to accept coins of a desired maximum diameter and width.

Referring again to FIGS. 1 & 2, a coin guide slot is shown adjacent to the upper edge of the coin entry slot. The coin guide slot is dimensioned to correspond substantially to the width of the coin entry slot. However, the coin guide slots can vary in dimension. For example, the width of the slot may be wider at the outer edge of the slot, and then narrow to the dimension of the coin entry slot at the inner edge of the slot, thereby allowing easier insertion of the coin into the guide and then proper alignment of the coin with the coin entry portal.

Again referring more specifically to FIGS. 1 & 2, the coin entry portal is illustrated with an inwardly inclined interior surface. The interior surface is angled such that the interior surface provides for a wider opening at the outside edge of the coin inlet portal that slopes inward to the coin entry slot. As illustrated, the inwardly sloping interior surface is a concave curvilinear surface that slopes toward the coin entry slot and the coin guide slot is positioned adjacent to the coin entry slot. Preferably, the size of the interior surface is such that it allows for the finger grasping a coin to engage the interior surface of the coin inlet portal, allowing the user to more precisely guide the coin into the coin entry slot. In addition, the inwardly sloping interior surface limits the movement of the fingers inside the coin inlet portal, thereby inhibiting a user from positioning fingers below the lower edge of the coin. Accordingly, a user is inhibited from being able to place a finger under the lower edge of the coin as it placed into the coin race in order to flick the coin upwards into the coin race.

The embodiment illustrated is shown with one coin guide slot adjacent the upper edge of the coin entry slot. However, the coin entry portal can include upper and lower coin guide slots. In such an embodiment, the coin guide slots can engage both the upper and lower edges of a coin and can be designed to do so simultaneously.

Figure 3:
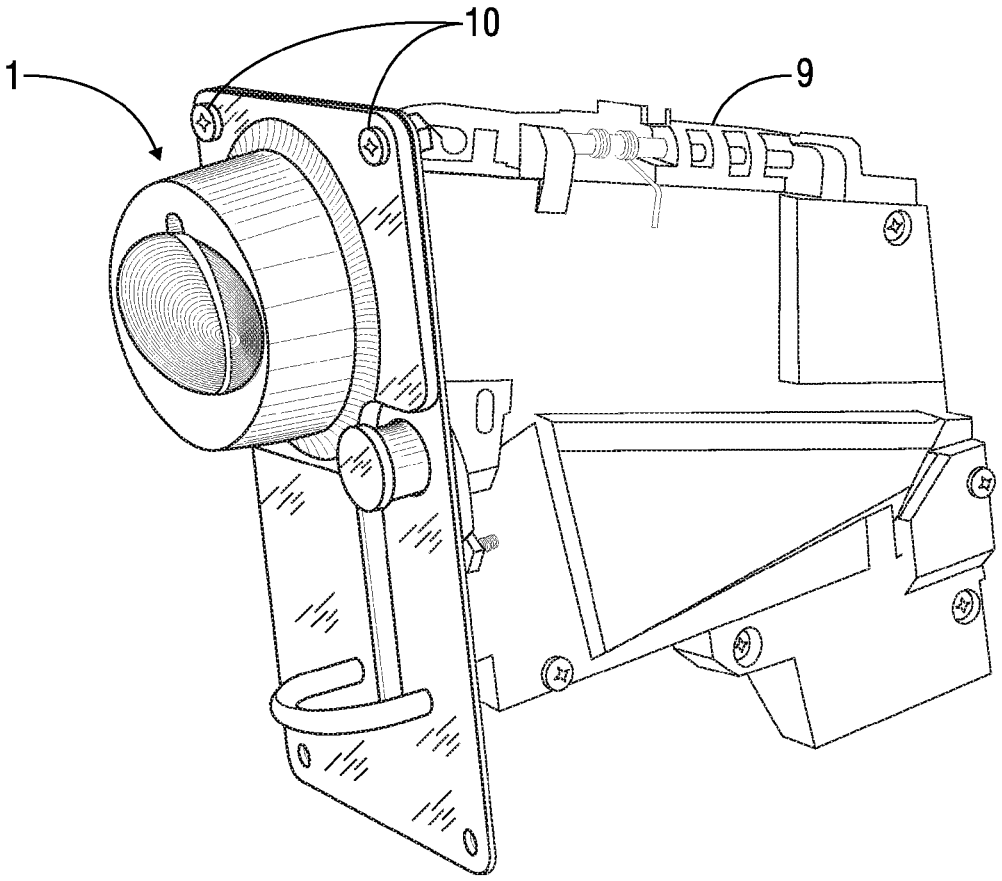
FIG. 3 illustrates a perspective view of one embodiment of the present invention showing the controlled coin inlet portal mounted on a coin acceptor/rejecter body.

Controlled coin inlet portal can be designed as an add-on feature attachable to existing coin acceptor/rejecter bodies with flat-faced coin inlet slots. Referring to FIG. 3, the controlled coin portal is shown attached to an acceptor/rejecter body. The attachment plate 7 is illustrated in corresponding engagement with the flat-face of the acceptor/rejecter body 9 and attached to the acceptor/rejecter body at the attachment points with fasteners 10. The fasteners can be of any suitable type, such as screws, rivets and the like. Those of skill in the art will recognize that the type of fastener used should not be easily removable.

Although the present invention is shown as attached to an acceptor/rejecter having a flat front, one of skill in the art will recognize that the coin entry portal of the present invention can be incorporated into a coin acceptor/rejecter to make a unitary device. In fact, as those of skill in the art will recognize, a unitary coin acceptor/rejecter can be designed wherein the controlled coin inlet or portal member can be recessed in the unitary device and the interior walls form an indentation. The outer edge of the indentation is formed into an opening dimensioned to be wider than the coin entry slot and sufficient to allow at least two fingers to position a coin within the indentation. Coin guide slots and other features as discussed above can be employed in such a unitary device.

The materials used to make the controlled coin portal of the present invention can be of any suitable material. The device can be easily molded to form a single piece from, for example, plastic.

The limitation on the movement of the fingers inside the well of the protruding coin portal provides for other anti-theft solutions. Thin wires, such as bra wires, are often inserted into coin races in order to attempt to manipulate the coin acceptance feature of the acceptor. The present invention limits the curve or angle of the wire, which inhibits the ability to manipulate the wire in such a way as to trigger the accept feature of the machine. In addition, liquids or debris are restricted from being inserted into the acceptor.

Many acceptors turn the coin at least once inside the acceptor and can de-bounce an improper coin. However on models that have very small footprints, there is insufficient room to turn and de-bounce such coins. The coin return area is directly underneath the coin inlet area and is sloped downwards at about 13 degrees for accept race and then 13 degrees back for the return race. The present invention allows for the necessary control of the coin flow in the very limited space found in many modern coin acceptor/rejecters.

This embodiment can be used on all machines that use coin acceptors. The best way to practice the invention is to keep the coin slot area of the protrusion substantially the same and change the outside or exterior of the coin portal to fit different applications or different machines.

This invention improves the function of using a controlled insertion of coins on all coin acceptors and specifically roll-down or drop model acceptors. The anti-cheat features also significantly benefits all acceptors and specifically the roll-down or drop models.

This disclosure is sufficient to enable one of ordinary skill in the art to practice the invention, and provides the best mode of practicing the invention presently contemplated by the inventor. While a full and complete disclosure is made of specific embodiments of this invention, the invention is not limited by the exact construction, dimensional relationships, and operation shown and described. Various modifications, alternative constructions, design options, changes and equivalents will be readily apparent to those skilled in the art and may be employed, as suitable, without departing from the spirit and scope of the invention. Such changes might involve alternative materials, components, structural arrangements, sizes, shapes, forms, functions, operational features and the like.

What is claimed is:

1. An apparatus, comprising: a coin portal member having an opening formed therein, said opening having an interior surface comprising interior walls, outer edges and inner edges, said inner edges formed into a coin entry slot dimensioned to allow entry of a coin of a selected maximum diameter and width, said outer edges formed into an opening dimensioned to be wider than said slot and sufficient to allow at least two fingers to position a coin within said coin portal member, said interior walls angled inwardly from said outer edges to said slot; wherein said coin entry slot comprises an upper edge and a lower edge along said interior wall; wherein at least one edge of said coin entry slot extends outwardly to form a guide slot; and wherein said guide slot is wider at the outer edge along the interior wall and narrower at the inner edge to the dimension of said coin entry slot.

2. An apparatus, comprising: a coin portal member comprising a protruding member having an opening formed therein, said opening having an interior surface comprising interior walls, outer edges and inner edges, said inner edges formed into a coin entry slot dimensioned to allow entry of a coin of a selected maximum diameter and width, said outer edges formed into an opening dimensioned to be wider than said slot and sufficient to allow at least two fingers to position a coin within said protruding member, said interior walls angled inwardly from said outer edges to said slot, said coin entry slot further comprising an upper edge and a lower edge along said interior wall; wherein both of said upper edge and said lower edge of said coin entry slot extend outwardly to form guide slots.

3. The apparatus of claim 2 wherein said guide slots are dimensioned to simultaneously engage coin edges as coins are inserted into said apparatus.

4. An apparatus comprising: a coin acceptor/rejecter having a coin entry portal; said coin entry portal comprising a protruding member having an opening formed therein, said opening having an interior surface comprising interior walls, outer edges and inner edges, said inner edges formed into a coin entry slot dimensioned to allow entry of a coin of a selected maximum diameter and width, said outer edges formed into an opening dimensioned to be wider than said slot and sufficient to allow at least two fingers to position a coin within said protruding member, said interior walls angled inwardly from said outer edges to said coin entry slot; wherein said coin entry slot comprises an upper edge and a lower edge along said interior wall; wherein both of said upper edge and said lower edge of said coin entry slot extend outwardly to form guide slots.

5. The apparatus of claim 4 wherein said guide slots are dimensioned to simultaneously engage coin edges as coins are inserted into said apparatus.

6. The apparatus of claim 5, wherein said guide slot is wider at the outer edge along the interior wall and narrower at the inner edge to the dimension of said entry slot.

7. The apparatus of claim 6, wherein said guide slots are wider at the outer edge along the interior wall and narrower at the inner edge to the dimension of said coin entry slot.

8. An apparatus, comprising: a protruding member having an exterior surface and an opening formed therein, said opening having an interior surface comprising interior walls, outer edges and inner edges, said inner edges formed into a coin entry slot dimensioned to allow entry of a coin of a selected maximum diameter and width, said outer edges formed into an opening dimensioned to be wider than said slot and sufficient to allow at least two fingers to position a coin within said protruding member, said interior walls angled inwardly from said outer edges to said slot, said coin entry slot further comprising an upper edge and a lower edge along said interior wall; wherein both of said upper edge and said lower edge of said coin entry slot extend outwardly to form guide slots.

9. The apparatus of claim 8 wherein said guide slots are dimensioned to simultaneously engage coin edges as coins are inserted into said apparatus.

10. An apparatus, comprising: a coin portal member having an opening formed therein, said opening having an interior surface comprising interior walls, outer edges and inner edges, said inner edges formed into a coin entry slot dimensioned to allow entry of a coin of a selected maximum diameter and width, said interior walls angled inwardly from said outer edges to said slot, said outer edges formed into an opening dimensioned to allow at least two fingers to position a coin within said coin portal member, said coin entry slot further comprising an upper edge and a lower edge that extend along said interior wall wherein at least one edge of said coin entry slot extends outwardly to form a guide slot, said guide slot wider at the outer edge along the interior wall and narrower at the inner edge to the dimension of said coin entry slot.

11. An apparatus comprising: a coin acceptor/rejecter having a coin entry portal; said coin entry portal having an opening formed therein, said opening having an interior surface comprising interior walls, outer edges and inner edges, said inner edges formed into a coin entry slot dimensioned to allow entry of a coin of a selected maximum diameter and width, and said outer edges formed into an opening dimensioned sufficiently to allow at least two fingers to position a coin within said coin entry portal, said coin entry slot further comprising an upper edge and a lower edge that extend along said interior walls to form upper and lower guide slots dimensioned to simultaneously engage coin edges as coins are inserted into said coin entry portal wherein at least one of said guide slots is wider at the outer edge along the interior wall and narrower at the inner edge to the dimension of said coin entry slot.

12. An apparatus comprising: a coin acceptor/rejecter having a coin entry portal; said coin entry portal having an opening formed therein, said opening having an interior surface comprising curvilinear interior walls, outer edges and inner edges, said inner edges formed into a coin entry slot dimensioned to allow entry of a coin of a selected maximum diameter and width, said curvilinear interior walls angled inwardly from said outer edges to said slot, said outer edges formed into an opening dimensioned to be wider than said slot and sufficient to allow at least two fingers to position a coin within said coin entry portal, said coin entry slot further comprising an upper edge and a lower edge that extend outwardly along said interior wall to form guide slots dimensioned to simultaneously engage coin edges as coins are inserted into said coin entry portal, wherein at least one edge of said guide slots is wider at the outer edge along the interior wall and narrower at the inner edge to the dimension of said entry slot.

* * * * *